US009232298B2

(12) United States Patent
Yeh

(10) Patent No.: US 9,232,298 B2
(45) Date of Patent: Jan. 5, 2016

(54) PORTABLE ELECTRONIC DEVICE WITH ENHANCED SOUND REPRODUCTION

(71) Applicant: Chiun Mai Communication Systems, Inc., New Taipei (TW)

(72) Inventor: Chien-Feng Yeh, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 114 days.

(21) Appl. No.: 14/101,508

(22) Filed: Dec. 10, 2013

(65) Prior Publication Data

US 2014/0341412 A1 Nov. 20, 2014

(30) Foreign Application Priority Data

May 15, 2013 (TW) ..... 102208985 U

(51) Int. Cl.
*H04R 1/02* (2006.01)
*H04R 1/28* (2006.01)

(52) U.S. Cl.
CPC ..... *H04R 1/2803* (2013.01); *H04R 1/021* (2013.01); *H04R 2499/11* (2013.01)

(58) Field of Classification Search
CPC ... H04R 1/021; H04R 1/2803; H04R 2499/11
See application file for complete search history.

(56) References Cited

U.S. PATENT DOCUMENTS

| | | | | |
|---|---|---|---|---|
| 5,821,471 | A * | 10/1998 | McCuller | 181/156 |
| 6,758,303 | B2 * | 7/2004 | Zurek et al. | 381/335 |
| 2009/0169041 | A1 * | 7/2009 | Zurek et al. | 381/345 |

* cited by examiner

*Primary Examiner* — Ping Lee
(74) *Attorney, Agent, or Firm* — Novak Druce Connolly Bove + Quigg LLP

(57) ABSTRACT

A miniaturized and portable electronic device with enhanced audio output includes a main body, an internal sound guiding pipe and a surface-mounted but internal loudspeaker. The main body defines a plurality of first sound holes and a plurality of second sound holes at respective ends of the main body. The interconnecting sound guiding pipe receives the portion of the sound waves generated by the loudspeaker which the loudspeaker does not direct to the outside of the main body, and such portion not directly output is collected by the sound guiding pipe to resonate and be transmitted to the second sound holes for outward emission.

7 Claims, 2 Drawing Sheets

PORTABLE ELECTRONIC DEVICE WITH ENHANCED SOUND REPRODUCTION

BACKGROUND

1. Technical Field

The present disclosure relates to a portable electronic device.

2. Description of Related Art

Miniaturization of electronic devices continues. Therefore, smaller loudspeakers are applied to the electronic devices to achieve miniaturization. However, the smaller loudspeakers commonly have lower sound volume, and lower audio quality. A plurality of smaller loudspeakers may be mounted in an electronic device to improve the sound quality and volume. However, the plurality of smaller loudspeakers in the electronic device defeats the attempts at miniaturization. Further, the plurality of smaller loudspeakers cannot always result in improved sound quality.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
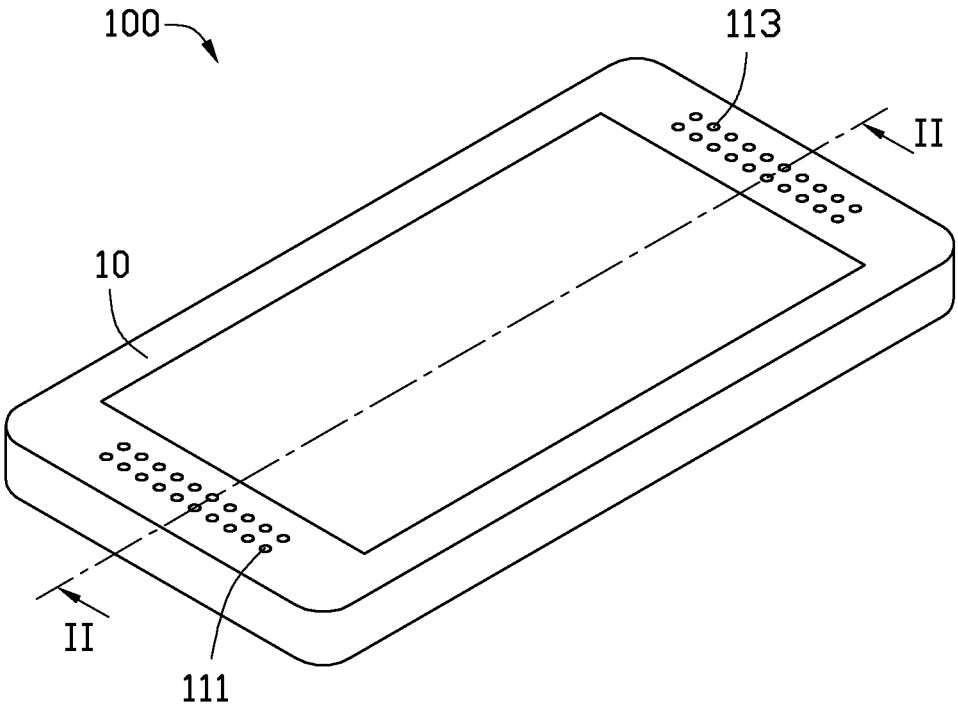
FIG. 1 is a schematic view of a portable electronic device in accordance with an exemplary embodiment.
Figure 2:
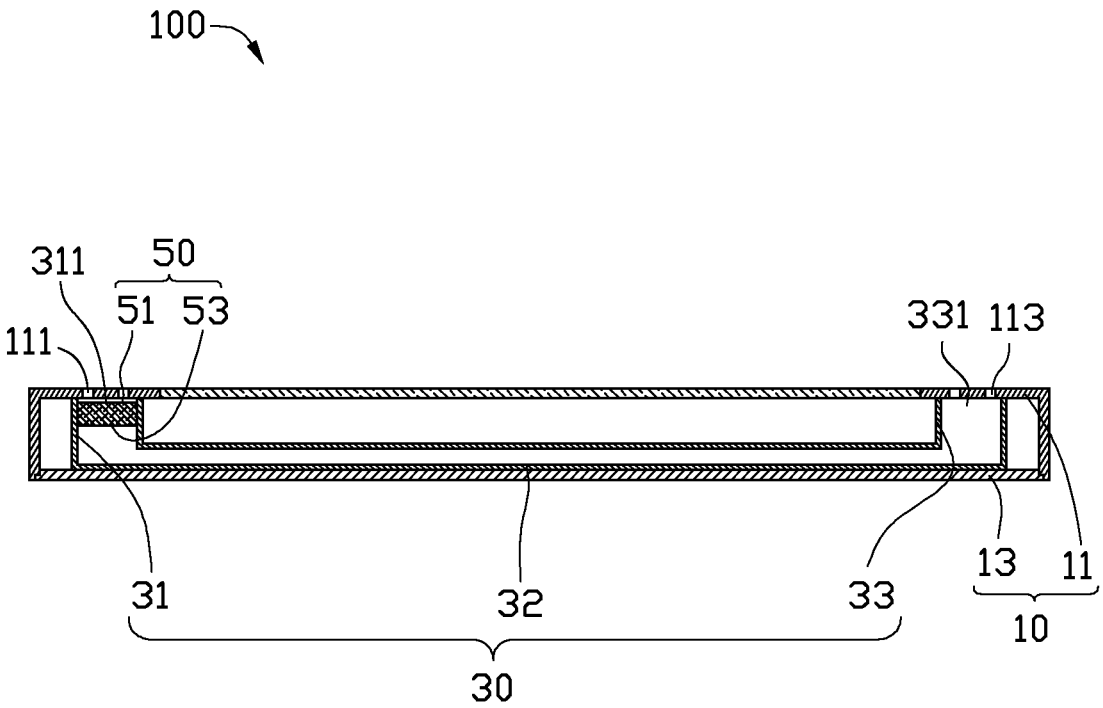
FIG. 2 is a cross-sectional view of the portable electronic device of FIG. 1 taken along line II-II.

FIGS. 1-2 show an exemplary embodiment of a portable electronic device 100 (hereinafter "electronic device 100"). The electronic device 100 may be a notebook computer, a mobile phone, a personal digital assistant, or the like.

The electronic device 100 includes a main body 10, a sound guiding pipe 30, and a loudspeaker 50. The sound guiding pipe 30 and the loudspeaker 50 are positioned in the main body 10.

Also referring to FIG. 2, the main body 10 includes a first housing 11, and a second housing 13 matching with the first housing 11. The first housing 11 may be a front cover of the electronic device 100, and the second housing 13 may be a rear cover of the electronic device 100.

The first housing 11 has two end portions each defining a plurality of sound holes, respectively first sound holes 111 and second sound holes 113 (see FIG. 1). The first sound holes 111 and the second sound holes 113 transmit the sound emitted by the loudspeaker 50 to the outside of the main body 10.

The sound guiding pipe 30 is substantially "U" shaped. The sound guiding pipe 30 includes a main portion 32, a first end 31 perpendicularly connected to one end of the main portion 32, and a second end 33 perpendicularly connected to the other end of the main portion 32. The main portion 32 of the sound guiding pipe 30 is positioned on the second housing 13, for effectively using the inner space of the main body 10, and thereby the thickness of the electronic device 100 can be reduced.

The first end 31 defines a first opening 311 which communicates with the first sound holes 111. The second end 33 defines a second opening 331 which communicates with the second sound holes 113. The loudspeaker 50 is received in the first end 31 with a first surface 51 facing the first sound holes 111. The loudspeaker 50 further includes a second surface 53 opposite to the first surface 51.

The loudspeaker 50 emits sound. A portion of the sound is transmitted from the first surface 51 to the first sound holes 111 and thus outside the electronic device 100. The other portion of the sound is transmitted from the second surface 53 to the sound guiding pipe 30 and resonates in the sound guiding pipe 30, being transmitted from the second sound holes 113 to the outside of the electronic device 100. Since the sound resonates in the sound guiding pipe 30, the volume and quality of sound transmitted out of the electronic device 100 are improved.

The relationship between the sound volume (designated "M") transmitted from the second sound holes 113, the length (designated "L") of the sound guiding pipe 30, and the section area (designated "S") of the sound guiding pipe 30 is $$M \approx \frac{\rho}{S}\left(L + 1.462\sqrt{\frac{S}{\pi}}\right),$$

wherein ρ is a density of air.

In the exemplary embodiment, the length (L) of the sound guiding pipe 30 is between about 6 centimeters (cm) to about 10 cm, the section area (S) of the sound guiding pipe 30 is between about 16 square centimeters ($cm^2$) to about 20 $cm^2$.

The sound emitted by the loudspeaker 50 resonates in the guiding pipe 30, thereby the sound volume and quality are improved. Thus with only a single loudspeaker 50 mounted in the electronic device 100, the quality of sound and volume of the electronic device 100 are enhanced. Furthermore, the sound guiding pipe 30 is embedded within the second housing 13. These features facilitate miniaturization of the electronic device 100.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A portable electronic device, comprising:

a main body defining a plurality of first sound holes and a plurality of second sound holes, the plurality of first sound holes being spaced apart from the plurality of second sound holes;

a sound guiding pipe comprising a first end and a second end, the first end communicating with the first sound holes, the second end communicating with the second sound holes; and a loudspeaker received in the first end, wherein when the loudspeaker emits sound, a first portion of the sound being transmitted to the first sound holes and the outside of the portable electronic device, and a second portion of the sound being transmitted to the sound guiding pipe to resonate and then be transmitted to the second sound holes and the outside of the portable electronic device, a relationship between the sound volume "M" transmitted from the second sound holes, the length "L" of the sound guiding pipe, and the section area "S" of the sound guiding pipe is $$M \approx \frac{\rho}{S}\left(L + 1.462\sqrt{\frac{S}{\pi}}\right),$$

and ρ is a density of air.

2. The portable electronic device as claimed in claim 1, wherein the sound guiding pipe further comprises a main portion, the first end perpendicularly connected to one end of the main portion and the second ends perpendicularly connected to a second end of the main portion.

3. The portable electronic device as claimed in claim 2, wherein the first end defines a first opening, the first opening communicates with the first sound holes, the second end defines a second opening, the second opening communicates with the second sound holes.

4. The portable electronic device as claimed in claim 1, wherein the main body comprises a first housing having two end portions, one of the end portions defines the first sound holes therein, and the other end portion defines the second sound holes therein, the loudspeaker comprises a first surface facing the first sound holes, the first portion of the sound emitted by the loudspeaker transmits from the first surface to the first sound holes and the outside of the portable electronic device.

5. The portable electronic device as claimed in claim 4, wherein the main body further comprises a second housing matching with the first housing, the main portion of the sound guiding pipe is located on the second housing.

6. The portable electronic device as claimed in claim 4, wherein the loudspeaker comprises a second surface opposite to the first surface, the second portion of the sound emitted by the loudspeaker is transmitted from the second surface to the sound guiding pipe and resonates in the sound guiding pipe, and then transmitted to the second sound holes and the outside of the portable electronic device.

7. The portable electronic device as claimed in claim 1, wherein the length of the sound guiding pipe is between about 6 cm to about 10 cm, the section area of the sound guiding pipe is between about 16 $cm^2$ to about 20 $cm^2$.

* * * * *